US005448006A

United States Patent [19]

Ming

[11] Patent Number: 5,448,006

[45] Date of Patent: Sep. 5, 1995

[54] MUSIC BOX

[76] Inventor: Lu S. Ming, P.O. Box 82-144, Taipei, Taiwan

[21] Appl. No.: 370,181

[22] Filed: Jan. 9, 1995

[51] Int. Cl.[6] ..... G10F 1/06

[52] U.S. Cl. ..... 84/95.1; 84/96

[58] Field of Search ..... 84/94.1, 94.2, 95.1, 84/95.2, 96

[56] References Cited

U.S. PATENT DOCUMENTS 555,757 3/1896 Bock ..... 84/96

4,570,524 2/1986 Isaka et al. ..... 84/96

*Primary Examiner*—Patrick J. Stanzione

*Attorney, Agent, or Firm*—Alfred Lei

[57] ABSTRACT

A music box including a base, a frame mounted on the base, a motor mounted on the frame, a drum installed on the base and including a cylinder provided with a plurality of protuberances, a gear having a recess, a plurality of fixing members on the recess and a square hole at a center of the gear, and a seat having a plurality of portions between every two of which there is a slot and each of which has a hook portion, one end of the cylinder being engaged between the fixing members and an inner edge of said gear, the seat being inserted into another end of the cylinder, a horizontal output shaft being formed at one end with a square portion and a plurality of knots close to the square portion, the horizontal output shaft being partially inserted into the cylinder through the seat with the square portion and knot engaged with the square hole of the gear and the hook portion of the seat respectively, and a vertical output shaft provided at a lower end with a cog meshed with the gear.

1 Claim, 3 Drawing Sheets

MUSIC BOX

BACKGROUND OF THE INVENTION

It has been found that the conventional music box (see FIG. 1) is simply a box with a mechanical device which utilizes a spring spring A1, a rotating leaf A2, a gear train A3, a drum A4 and a hitting member A5 to produce a tune when the box is opened. However, such a music box is monotonous and too complicated in structure thereby increasing the cost thereof.

Therefore, it is an object of the present invention to provide a music box which may obviate and mitigate the above-mentioned drawbacks.

SUMMARY OF THE INVENTION

This invention relates to an improved music box.

It is the primary object of the present invention to provide a music box which has two output shafts.

It is another object of the present invention to provide a music box which is sturdy in construction.

It is still another object of the present invention to provide a music box which is easy to assemble.

It is still another object of the present invention to provide a music box which is facile to manufacture.

It is a further object of the present invention to provide a music box which is amusing and interesting.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
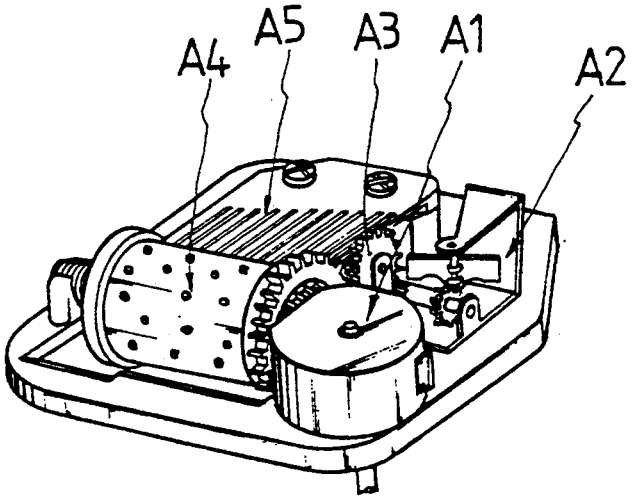
PRIOR ART FIG. 1
FIG. 1 is a perspective view of a prior art music box.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
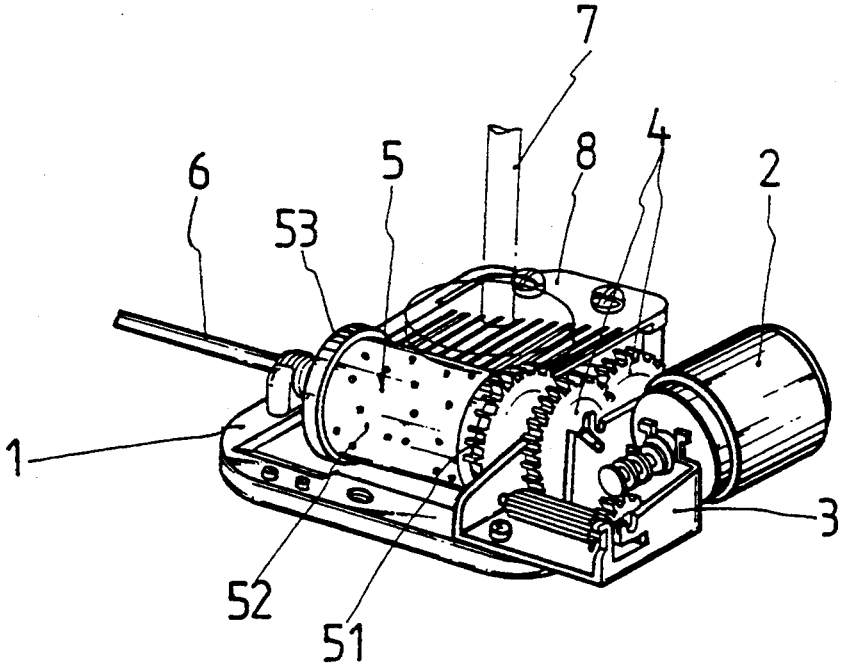
FIG. 2 is a perspective view of a music box according to the present invention.
Figure 3:
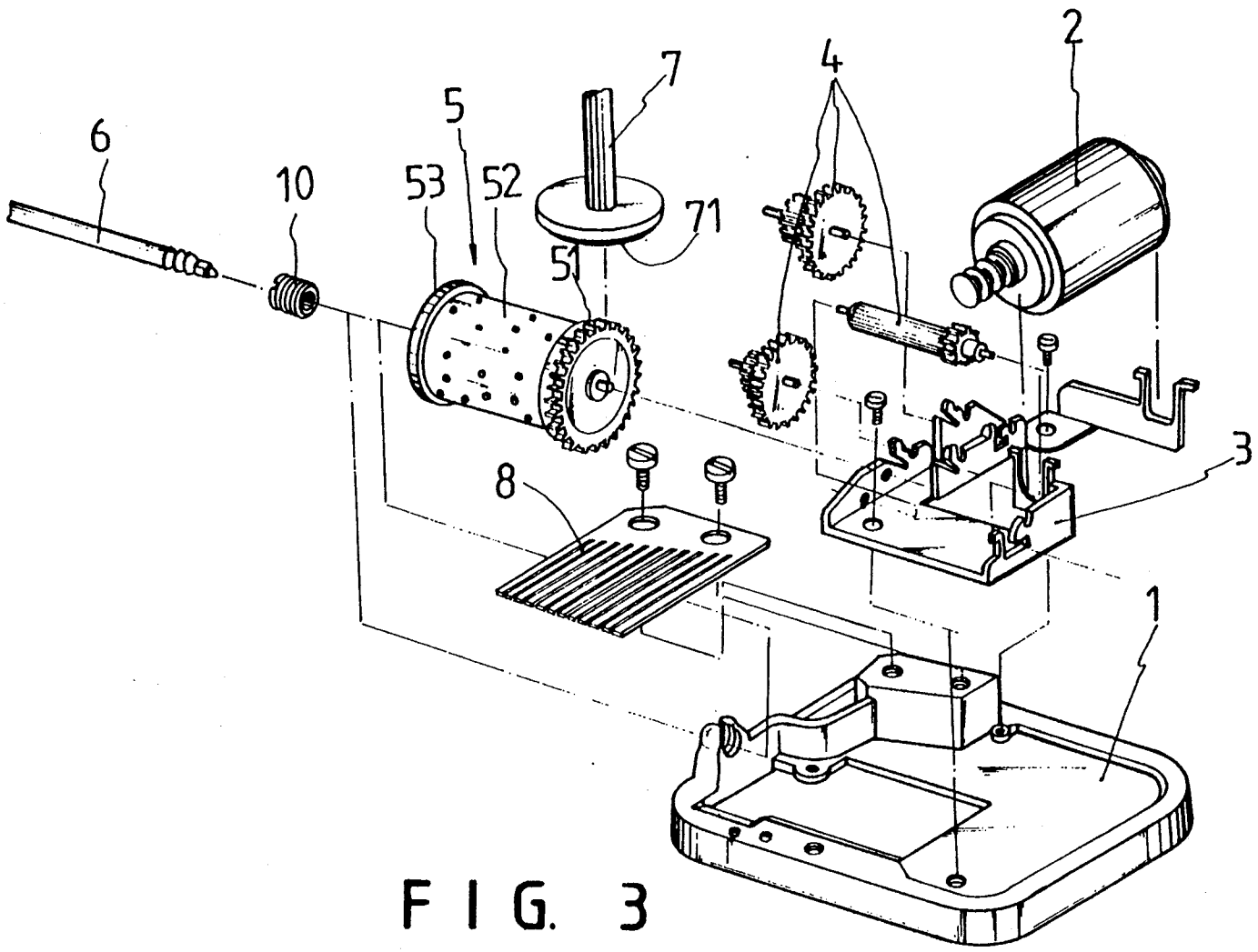
FIG. 3 is an exploded view of the music box according to the present invention.

With reference to the drawings and in particular to FIGS. 2 and 3 thereof, the music box according to the present invention mainly comprises a base 1, a motor 2, a frame 3, a gear train 4, a drum 5, a horizontal output axle 6, a vertical output axle 7, and a hitting member 8.

Figure 4:
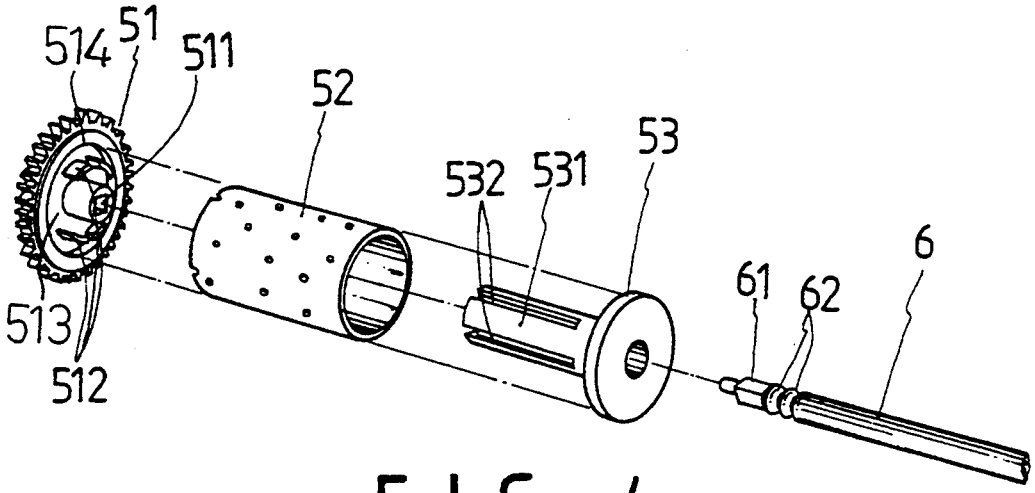
FIG. 4 is an exploded view of the drum.
Figure 5:
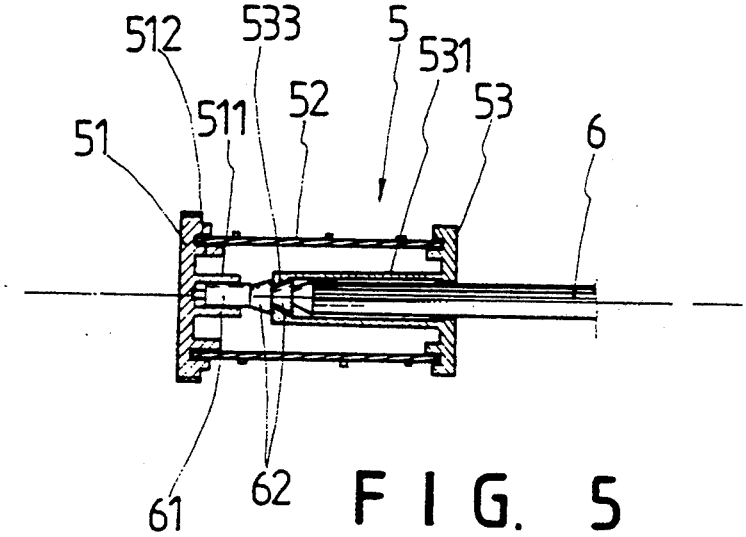
FIG. 5 is a sectional view of the drum.

As illustrated, the motor 2 and the frame 3 are fixedly installed on the base 1. The gear train 4 is mounted on the frame 3 and engaged with an output shaft of the motor 2. The drum 5 is mounted on the base 1 and includes a cylinder 52 provided with a plurality of protuberances, a gear 51 having a recess 513, a plurality of fixing members 512 on the recess 513 and a square hole 511 at the center, and a seat 53 having a plurality of longitudinal portions 531 between every two of which there is a slot 532 and each of which has a hook portion 533 (see FIGS. 4 and 5). One end of the cylinder 52 is engaged between the fixing members 512 and the inner edge 514 of the gear 51. The seat 53 is inserted into the other end of the cylinder 52.

Figure 6:
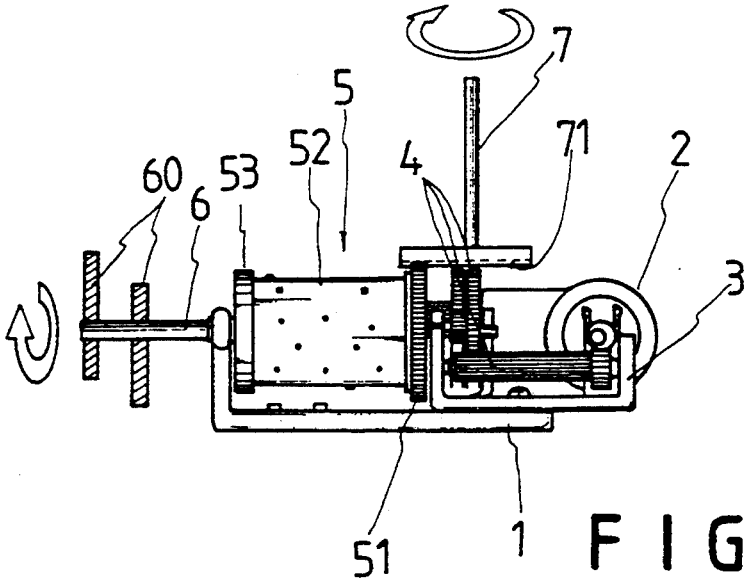
FIG. 6 is a working view of the music box according to the present invention.

The horizontal output shaft 6 is formed at one end with a square portion 61 and a plurality of knots 62 close to the square portion 61. The horizontal output shaft 6 is partially inserted into the cylinder 52 through the seat 53, with its square portion 61 and knot 62 engaged with the square hole 511 of the gear 51 and the hook portion 533 of the seat 53 respectively. The other end of the horizontal output axle 6 is engaged with a plurality of wheels 60 (see FIG. 6) which can be connected with desired figurines or the like (not shown).

The vertical output axle 7 is provided at the lower end with a cog 71 which is meshed with the gear 51 of the drum 5 so that when the drum 5 is rotated, the vertical output axle 7 will be rotated therewith. It should be noted, however, that a doll or the like can be mounted on the vertical output axle 7.

When the motor 2 is turned on, the motor 2 will drive the gear 51 to rotate through the gear train 4 thereby rotating the drum 5. As the drum 5 is rotated, the horizontal output axle 6 and the vertical output axle 7 will be rotated therewith. In the meantime, the tines of the hitting member 8 will hit the protuberances 52 of the drum 5 hence producing music.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A music box comprising:

a base;

a frame mounted on said base;

a motor mounted on said frame;

a drum installed on said base and including a cylinder provided with a plurality of protuberances, a gear having a recess, a plurality of fixing members on the recess and a square hole at a center of the gear, and a seat having a plurality of portions between every two of which there is a slot and each of which has a hook portion, one end of said cylinder being engaged between said fixing members and an inner edge of said gear, said seat being inserted into another end of said cylinder;

a horizontal output shaft being formed at one end with a square portion and a plurality of knots close to the square portion, said horizontal output shaft being partially inserted into said cylinder through said seat with the square portion and knot engaged with the square hole of said gear and the hook portion of said seat respectively; and a vertical output shaft provided at a lower end with a cog meshed with said gear.

* * * * *